US010018433B2

(12) United States Patent
Tuason et al.

(10) Patent No.: US 10,018,433 B2
(45) Date of Patent: Jul. 10, 2018

(54) LINEAR LOCKING BARREL SYSTEM FOR FIREARM

(71) Applicant: Armscor Precision International, Pahrump, NV (US)

(72) Inventors: Martin O. Tuason, Pahrump, NV (US); Frederick E. Craig, Burton, KS (US)

(73) Assignee: ARMSCOR PRECISION INTERNATIONAL, Pahrump, NV (US)

( * ) Notice: Subject to any disclaimer, the term of this patent is extended or adjusted under 35 U.S.C. 154(b) by 0 days.

(21) Appl. No.: 15/406,677

(22) Filed: Jan. 14, 2017

(65) Prior Publication Data

US 2018/0066904 A1 Mar. 8, 2018

Related U.S. Application Data

(60) Provisional application No. 62/382,860, filed on Sep. 2, 2016.

(51) Int. Cl.
*F41A 3/00* (2006.01)
*F41A 3/46* (2006.01)
*F41C 3/00* (2006.01)

(52) U.S. Cl.
CPC . *F41A 3/46* (2013.01); *F41C 3/00* (2013.01)

(58) Field of Classification Search
CPC ..... F41A 3/36; F41A 3/38; F41A 3/40; F41A 3/44; F41A 3/46; F41A 3/86; F41A 5/02; F41A 5/14; F41C 3/00
See application file for complete search history.

(56) References Cited

U.S. PATENT DOCUMENTS 1,382,197 A * 6/1921 Jolidon ..... F41A 3/68 42/75.01
1,431,979 A * 10/1922 Pomeroy ..... F41A 3/44 89/170
2,846,926 A * 8/1958 Kimball ..... F41A 3/54 42/7
4,915,011 A * 4/1990 Smith ..... F41A 3/38 89/176
6,129,000 A * 10/2000 Schmid ..... F41A 3/16 89/187.01
9,546,831 B2 * 1/2017 Bandini ..... F41A 3/44
(Continued)

FOREIGN PATENT DOCUMENTS

WO WO 2017182843 A1 * 10/2017 ..... F41A 3/44

*Primary Examiner* — Gabriel Klein
(74) *Attorney, Agent, or Firm* — Bennet K. Langlotz; Langlotz Patent & Trademark Works, Inc.

(57) ABSTRACT

A linear locking barrel system for a firearm may include a frame, a slide movably mounted on the frame and defining a barrel channel, a barrel at least partially positioned in the barrel channel of the slide and being movable with respect to the frame and slide along a linear path, and a locking member configured to lock movement of the slide with the barrel for at least a portion of rearward recoil movement of the barrel. The locking member has an engaged condition in which the locking member locks the barrel and slide together and a disengaged condition in which the locking member releases the slide from the barrel during rearward recoil movement.

24 Claims, 10 Drawing Sheets

(56) References Cited

U.S. PATENT DOCUMENTS

| | | | | |
|---|---|---|---|---|
| 2012/0085225 | A1* | 4/2012 | Vanek | F41A 5/06<br>89/163 |
| 2015/0316336 | A1* | 11/2015 | Lee | F41A 3/38<br>42/16 |
| 2016/0223276 | A1* | 8/2016 | Serandour | F41A 3/46 |

* cited by examiner

LINEAR LOCKING BARREL SYSTEM FOR FIREARM

CROSS-REFERENCE TO RELATED APPLICATION

This application claims the benefit of U.S. Provisional Patent Application No. 62/382,860 filed on Sep. 2, 2016, entitled "Linear Locking Barrel System for Firearm," which is hereby incorporated by reference in its entirety for all that is taught and disclosed therein.

FIELD OF THE INVENTION

The present disclosure relates to firearms and more particularly pertains to firearms having linear recoil movement of the barrel during firing.

BACKGROUND OF THE INVENTION

Firearms such as center fire pistols often utilize a barrel and a slide for operation of the firearm, including the ejection of a spent cartridge casing from the firearm. Typically, these firearms operate with an "out of battery delay" during the recoil movement of the barrel and slide, and utilize a mechanical or gas-type delay to unlock the movement of the slide from the barrel.

A popular approach to unlocking the slide from the barrel during recoil movement utilizes a tilting barrel design, which has locking lugs on the barrel that engage locking lugs on the slide, and when the barrel is cammed or moved upward these lugs engage each other to create a locked breech. Under firing recoil movement, the slide and barrel are driven rearward and a lower pivot link of the barrel pulls the barrel away from the slide in a motion that tilts the muzzle end of the barrel upward and disengages the locking lugs of the barrel and slide to permit the slide to continue rearward movement to eject the spent casing. The tilting barrel design for producing the out-of-battery delay is by far the most common approach.

The current inventors have recognized that the tilting barrel approach has several shortcomings, including reduced accuracy due at least in part to the fact that, during recoil, the tilting movement of the barrel begins almost immediately. Since the sights of the firearm are located on the slide, any movement of the slide before the projectile leaves the barrel muzzle can cause problems with targeting accuracy. Further, the current inventors have realized that the tilting barrel approach can cause problems in the design and production of the firearm, as the compound tilting and shifting movement of the barrel from the locked position to the unlocked position can make it difficult to control the fit of the barrel to the slide.

Moreover, the current inventors recognized that the tilting motion of the barrel causes the cartridge to also move up and down across the breech face, which complicates the design and operation of the extractor since the extractor must remove the cartridge casing from the barrel chamber as the rim of the casing is moving downwardly, which ultimately affects the purchase that the extractor is able to achieve with the rim of the case. As a result, the location of the extractor is lower on the breech face which in turn complicates the loading movement of a cartridge from the magazine to the barrel chamber.

Therefore, there is a need to provide a firearm that provides alternative to the tilting barrel design to improve accuracy. In this regard, various embodiments of the present disclosure substantially fulfill at least some of these needs. In this respect, certain embodiments of the firearm or methods according to the present disclosure substantially departs from the conventional concepts and designs of the prior art, and in doing so provides an apparatus and method that provides a linear recoil movement of the barrel while still providing the desired out-of-battery delay, thereby improving accuracy, robustness, and reduction in complexity.

SUMMARY OF THE INVENTION

Certain aspects of the present disclosure relate to a firearm having a front and a rear, and the firearm may comprise a frame defining a guide rod chamber, and a slide mounted on the frame to move between a forward position and a rearward position. The slide may define a barrel channel, and have a forward boss and a rearward boss spaced from the forward boss to form a gap. The firearm may include a barrel having a bore and being at least partially positioned in the barrel channel of the slide and being movable between a forward position and a rearward position. The barrel may be confined to move between the forward and rearward positions along a linear path. The firearm may also include a locking member configured to lock movement of the slide with the barrel for at least a portion of rearward recoil movement of the barrel from the forward position of the barrel toward the rearward position of the barrel. The locking member may have an engaged condition in which the locking member locks the barrel and slide together and a disengaged condition in which the locking member releases the slide from the barrel during rearward recoil movement.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, as well as the particulars of the steps or actions, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DESCRIPTION OF THE CURRENT EMBODIMENT

Figure 1A:
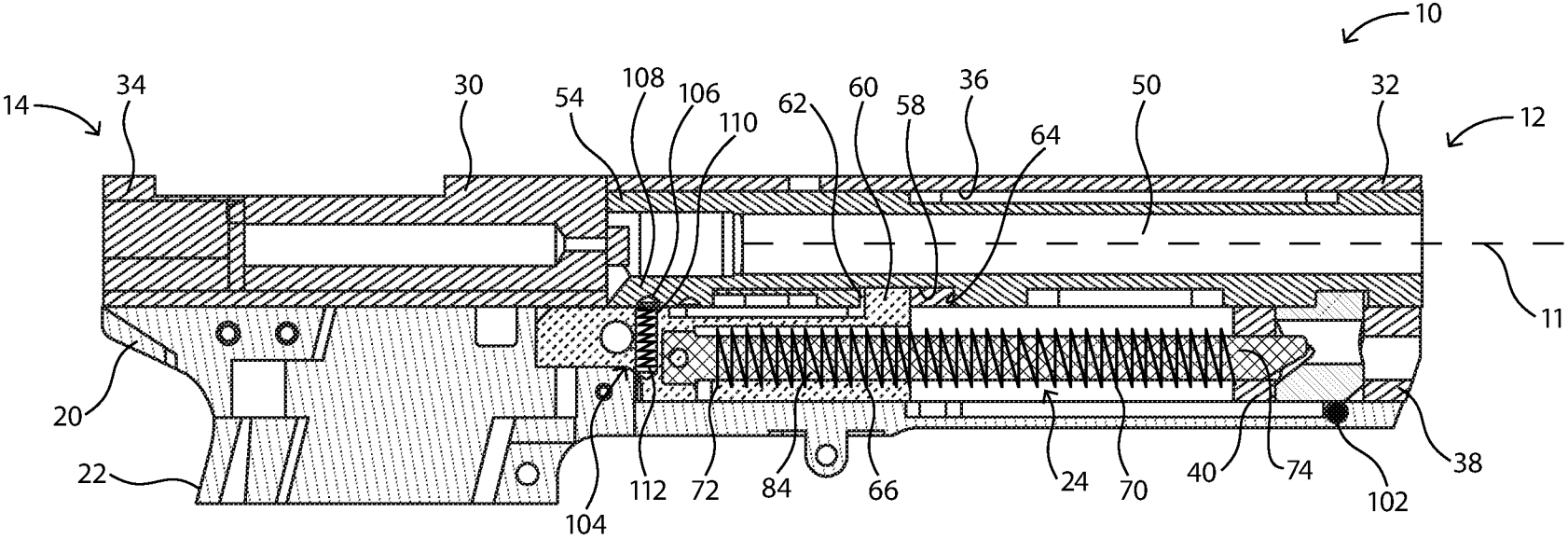
FIG. 1A is a schematic side sectional view of selected elements of a new linear locking barrel system on a firearm, according to the present disclosure, with the barrel and slide shown in the respective forward positions and the locking member shown in the engaged condition.
Figure 1B:
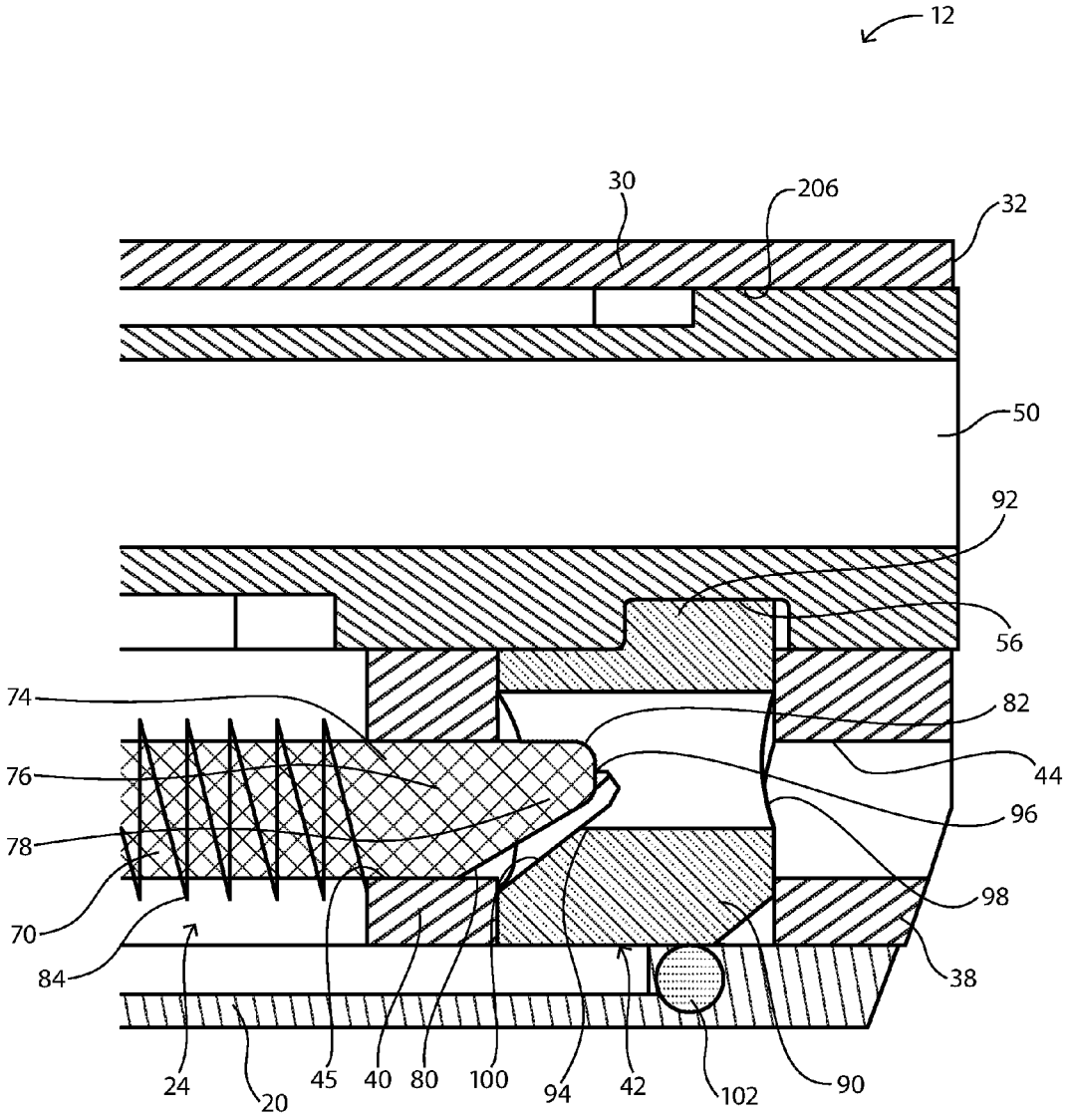
FIG. 1B is a portion of the schematic side sectional view of FIG. 1A enlarged to reveal detail.
Figure 2A:
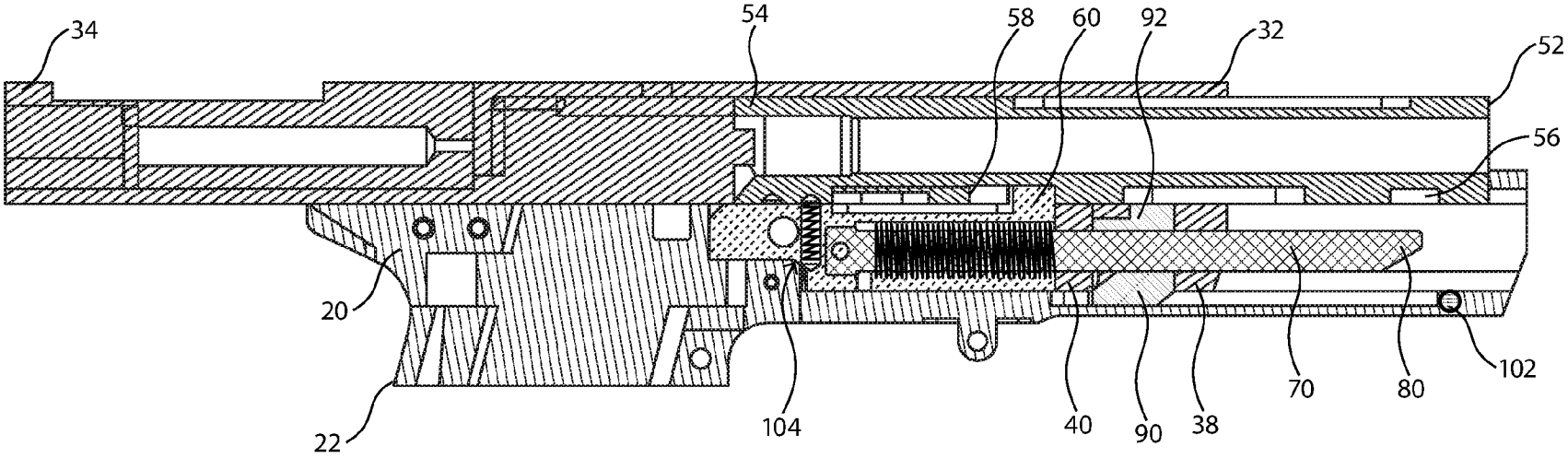
FIG. 2A is a schematic side sectional view of the selected elements of the linear locking barrel system on a firearm, with the barrel and slide shown in the respective rearward positions and the locking member shown in the disengaged condition, according to an illustrative embodiment.
Figure 2B:
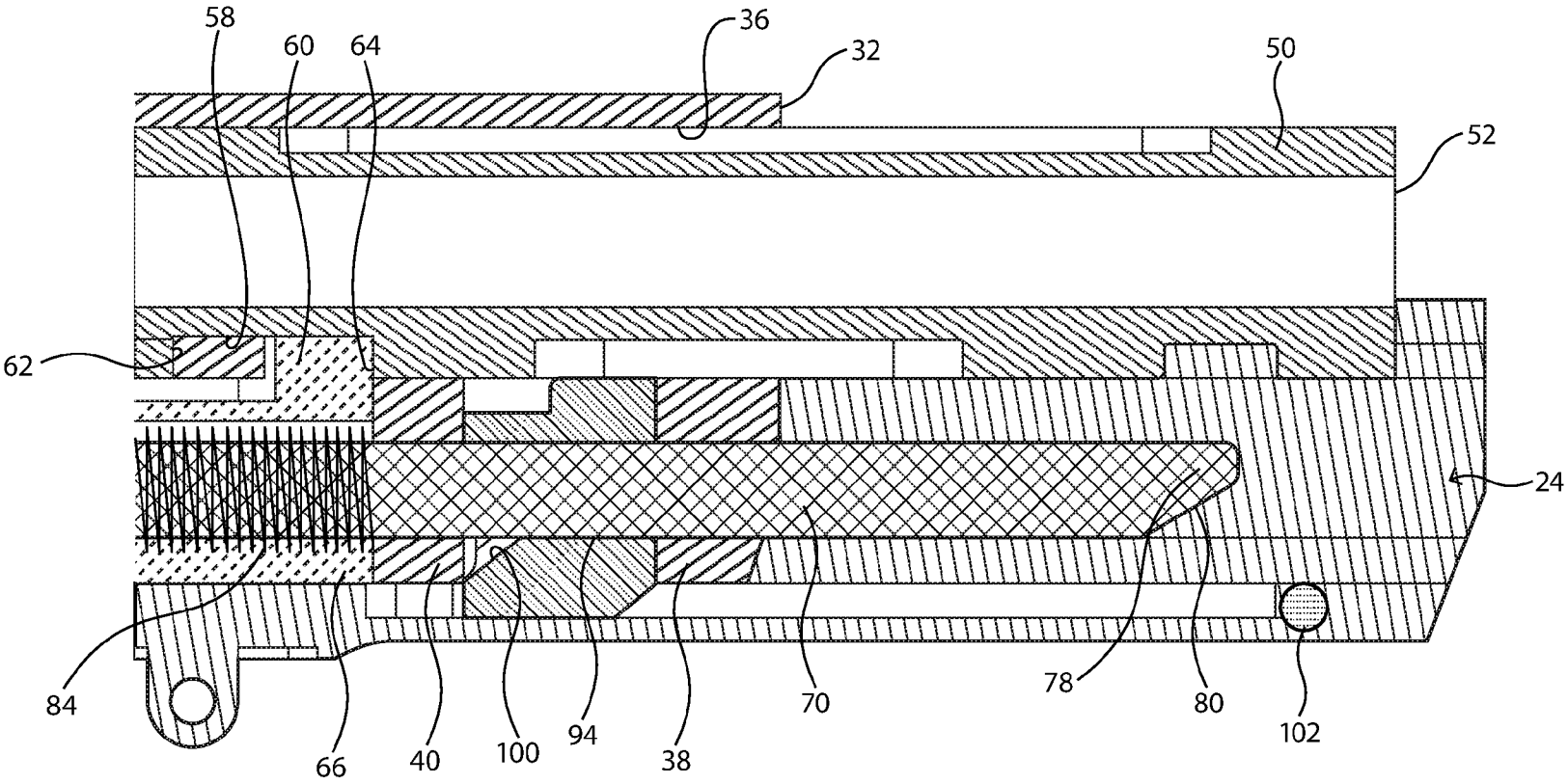
FIG. 2B is a portion of the schematic side sectional view of FIG. 2A enlarged to reveal detail.
Figure 3:
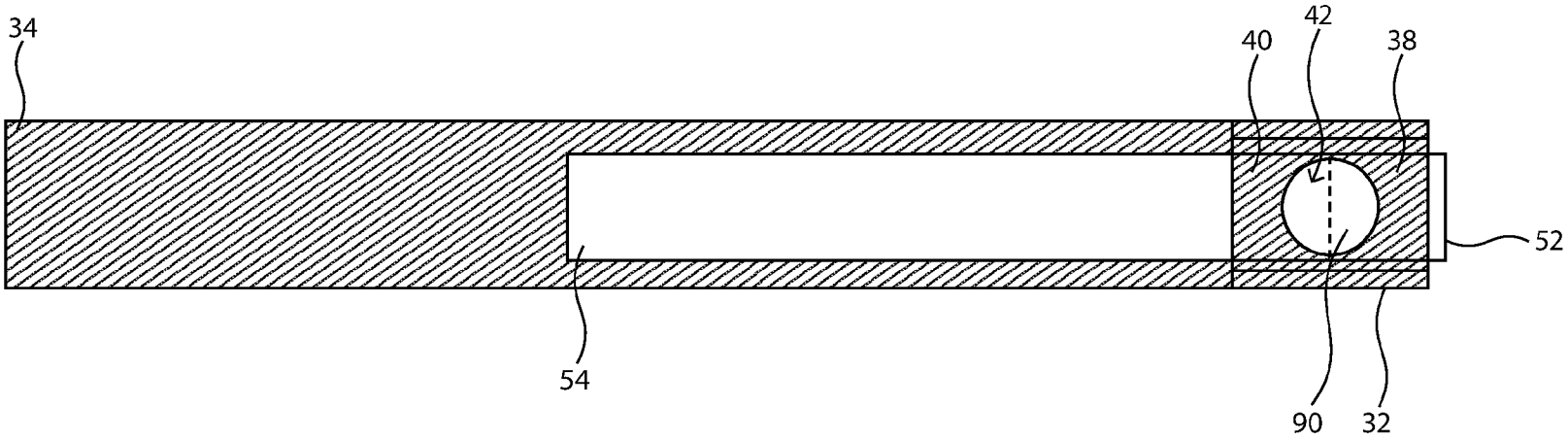
FIG. 3 is a schematic bottom sectional view of selected elements of the linear locking barrel system, according to an illustrative embodiment.

Referring now to FIGS. 1-7, in one embodiment, a firearm 10 may generally have a front 12 from which a projectile is ejected as well as a rear 14 which is generally oriented toward the user when the firearm is being fired. Although the firearm is depicted as a handgun for the purposes of this description, it should be recognized that concepts and elements of the disclosure may be utilized on other types of firearms.

The firearm 10 can include a frame 20, which can include a hand grip 22 for being gripped by the hand of the user during operation of the firearm. The frame can further include a guide rod chamber 24 which may be located toward the front 12 of the firearm.

The firearm 10 may also include a slide 30 which is generally slidably mounted on the frame 22 to move between a forward position in which the slide is oriented relatively closer to the front 12 of the firearm, and a rearward position in which the slide is oriented relatively closer to the rear 14 of the firearm. Generally the forward position of the slide corresponds to a pre-firing condition of the firearm, and the rearward position corresponds to the position of the slide after firing of the firearm but prior to subsequent forward movement of the slide back to the forward position. The slide 30 can include a front 32 generally oriented towards the front 12 of the firearm and a rear 34 generally oriented toward the rear 14 of the firearm. The slide 30 can include a barrel channel 36 which may extend from the front 32 of the slide rearwardly toward the rear 34 of the slide.

Figure 4:
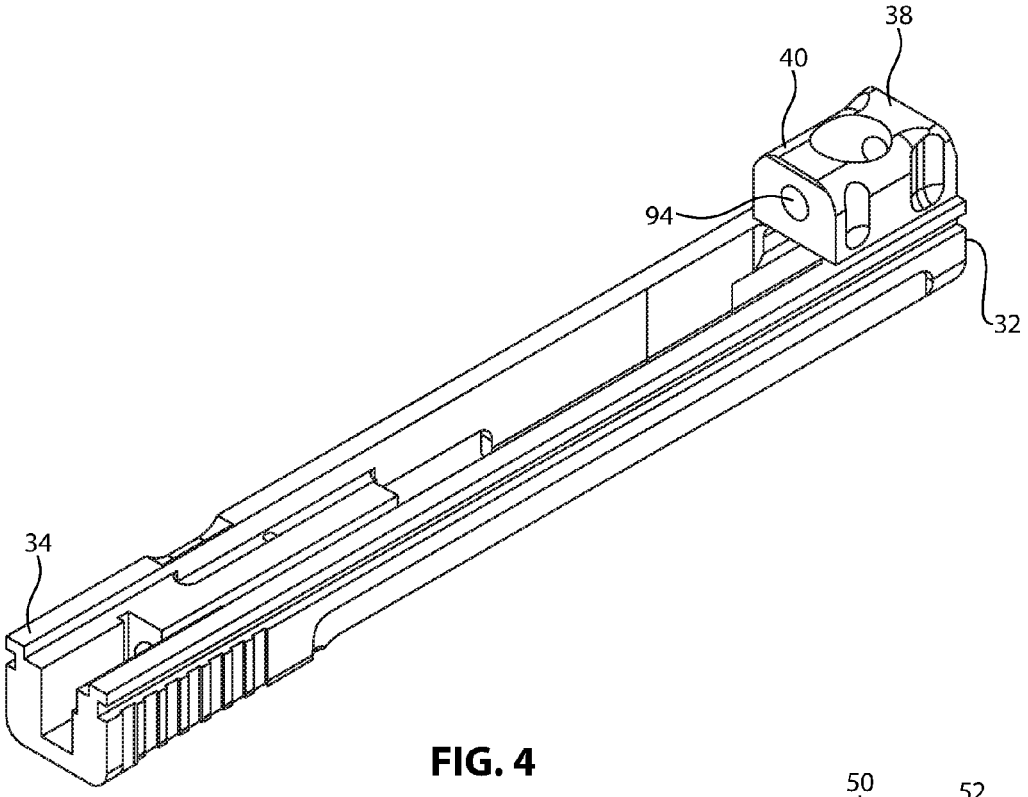
FIG. 4 is a perspective view of a slide according to one embodiment.

As particularly illustrated in FIG. 4, the slide 30 can include a forward boss 38 which is positioned toward the front 32 of the slide and may also have a rearward boss 40 which is located rearwardly of the forward boss 38. The rearward boss 40 may be spaced from the forward boss 38 to form a gap 42 between the bosses. Each of the bosses 38, 40 may define an aperture 44, 45 and the apertures may be substantially aligned along an axis oriented generally parallel to the firing axis 11 of the firearm. The bosses 38, 40 may extend into the guide rod chamber 24, and may be positioned in a forward section of the chamber 24 when the slide is in the forward position, and the bosses may move toward a rearward section when the slide is in the rearward position.

Figure 5:
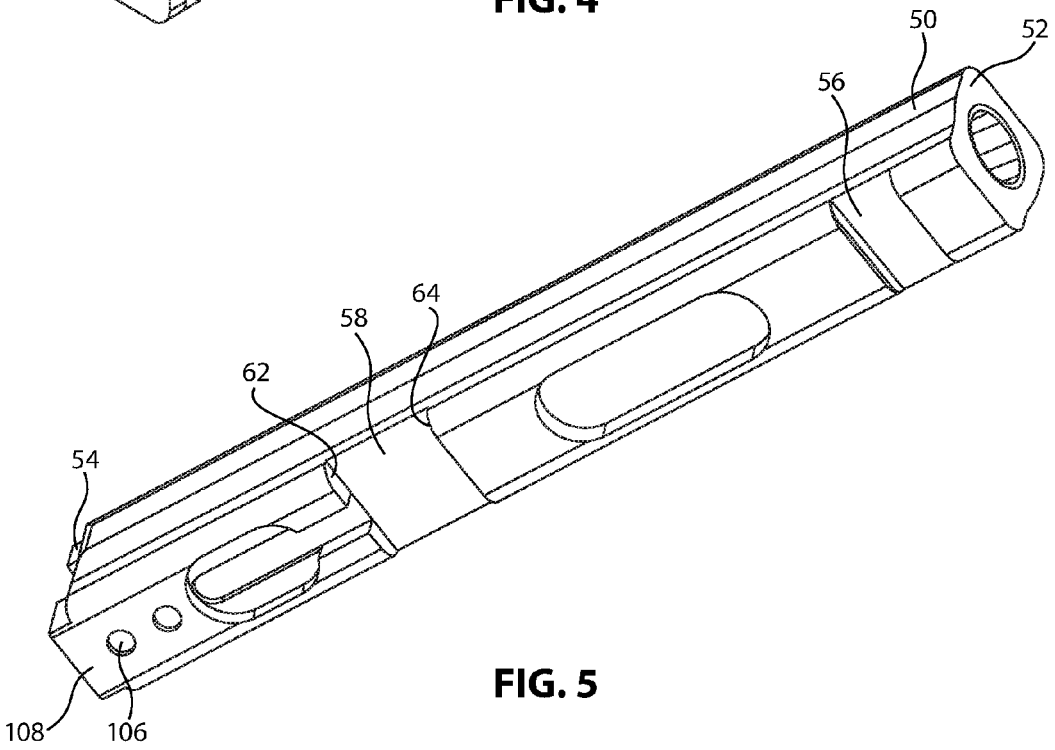
FIG. 5 is a bottom perspective view of a barrel according to one embodiment.

As particularly illustrated in FIG. 5, the firearm 10 may also include a barrel 50 with a bore for receiving at least a portion of the cartridge and guiding movement of the projectile of the cartridge upon firing of the firearm. The bore of the barrel generally extends along the firing axis of the firearm. The barrel 50 may be at least partially positioned in the barrel channel 36 of the slide 30. The barrel 50 has a muzzle end 52 which is generally oriented towards the front 12 of the firearm and a chamber end 54 which is generally oriented towards the rear 14. The barrel 50 may be movably mounted on the frame 20, and may be movable between a forward position and a rear position. Generally the forward position of the barrel 50 corresponds to a pre-firing condition of the firearm, and the rearward position corresponds to the position of the barrel after firing of the firearm but prior to forward movement of the barrel back to the forward position. The rearward position of the barrel typically does not correspond to the rearward position of the slide, as the distance between the forward and rearward positions of the slide generally exceeds the distance between the forward and rearward positions of the barrel. In other words, the barrel and the slide can move together initially and then independently of each other, and particularly, can move independently of each other in a generally linear path, i.e. generally parallel to the firing axis of the firearm. For example, the mounting of the barrel 50 may be configured such that movement of the barrel between the positions is constrained to a linear path or a path along a straight line extending between the positions.

The barrel 50 may include a locking recess 56 which may be oriented toward the guide rod chamber 24 of the frame and located generally toward the muzzle end 52 of the barrel. The barrel may also include a stop recess 58 which also may be oriented toward the guide rod chamber 24 and may be located rearwardly of the locking recess 56 on the barrel. A barrel stop 60 may be configured to limit movement of the barrel during recoil movement of the barrel. The barrel stop 60 may extend into the stop recess 58 to define or set one or more of the positions of the barrel. In embodiments, the barrel stop 60 may be configured to set the limit of forward movement of the barrel, and thus the forward position of the barrel. In embodiments, the barrel stop 60 may be configured to set the limit of rearward (recoil) movement of the barrel, and thus the rearward position of the barrel. At the forward position of the barrel 50, the barrel stop 60 may engage a first end 62 of the stop recess, and at the rearward position of the barrel, the barrel stop may engage a second end 64 of the stop recess. The barrel stop may be mounted on and fixed to the frame 20 and in some embodiments may be formed by a barrel stop element 66 which is at least partially positioned in the guide rod chamber 24.

Figure 6:
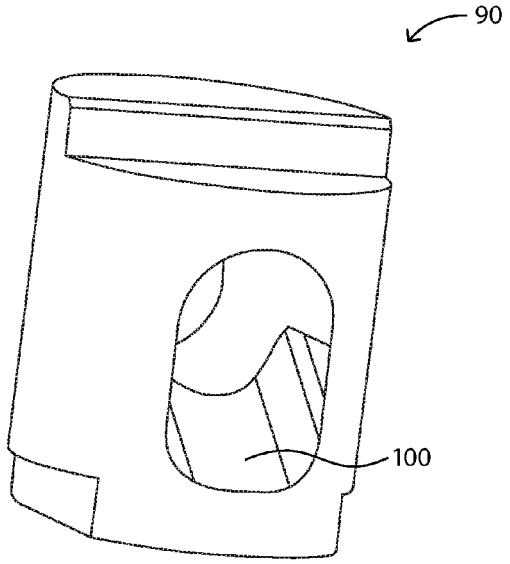
FIG. 6 is a perspective view of a guide rod according to one embodiment.
Figure 7:
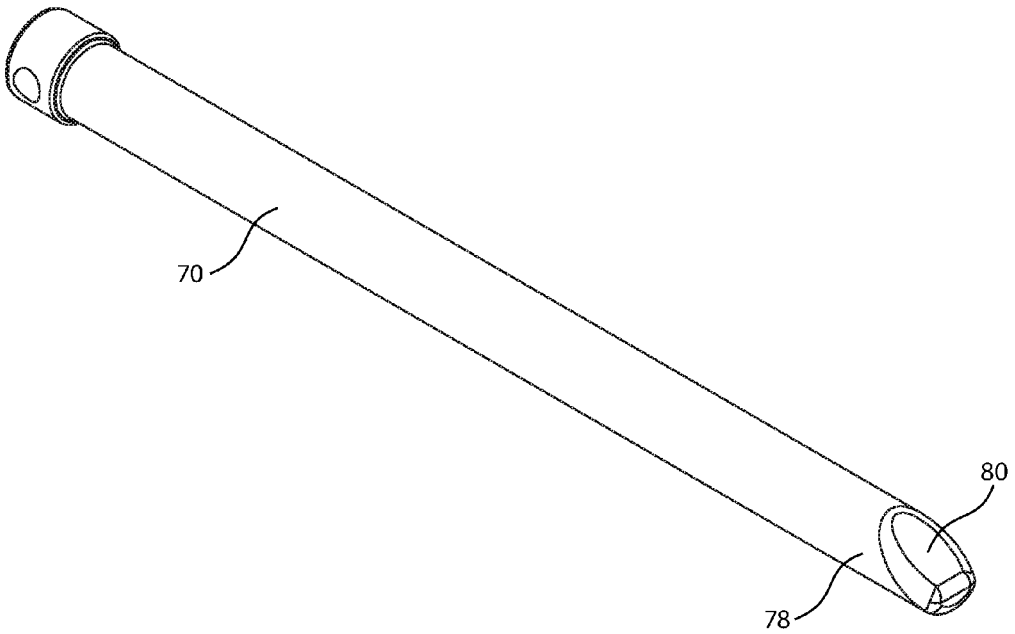
FIG. 7 is a perspective view of a locking member according to one embodiment.

A first actuator assembly can be configured to actuate the locking member into a disengaged position. In embodiments, the first actuator assembly can include a guide rod 70 which may be configured to guide movement of the slide 30 for at least a portion of the movement of the slide between the forward and rearward positions of the slide. The guide rod 70 may be located in the guide rod chamber 24 and may also position the recoil spring in the chamber 24. The guide rod may have a fixed end 72 which is mounted on the frame 20 and may also have a free end 74 which is positioned in the rod chamber 24 forwardly of the fixed end 72. A further perspective view of the just the guide rod is illustrated in FIG. 6.

A forward portion 76 of the guide rod may form a ram 78, which may extend through the aperture of at least one of the bosses 38, 40. In the illustrative embodiments, the ram 78 may be positioned in the aperture 45 of the rearward boss 40 when the slide 30 is in the forward position, and when the slide moves from the forward position toward the rearward position, the ram may move through the gap 42 and into the aperture 44 of the forward boss 38. The ram 78 may have a guide surface 80 extending from the free end 74 toward the fixed end, and may be oriented away from the barrel 50. In some embodiments, the guide surface 80 may form a ramp that is sloped to taper the thickness of the forward portion 76 of the guide rod which forms the ram. A spring 84 for biasing the slide 30 toward the forward position may be positioned in the guide rod chamber 24 and may be positioned on the guide rod 70. The spring 84 may engage the rearward boss 40 of the slide as the slide moves rearwardly from the forward position toward the rearward position.

A locking member 90 may be configured to lock movement of the slide with the barrel for a portion of the rearward recoil movement of the barrel upon firing of the firearm so that recoil movement of the barrel is transferred to the slide. The locking member 90 may have an engaged condition in which the locking member locks movement of the barrel and slide together, and a disengaged condition in which the locking member releases the slide from the barrel such that the slide may continue moving independently of the barrel even as the barrel discontinues rearward movement. The engaged condition of the locking member may correspond to an engaged position of the locking member (see, e.g., FIGS. 1A and 1B) and the disengaged condition of the member 90 may correspond to a disengaged position (see, e.g., FIGS. 2A and 2B). Further, the engaged position can correspond to a pre-firing condition and the disengaged position can correspond to a full recoil position. In the engaged position, the locking member may be located in closer proximity to the barrel than in the disengaged position. Movement of the locking member between the engaged and disengaged positions may be directed substantially perpendicular to the firing axis 11 of the firearm. Movement of the locking member 90 between the engaged and disengaged positions typically also occurs in conjunction with movement of the locking member between forward and rearward positions for the locking member and in a direction that is substantially parallel to the firing axis 11. Generally, the engaged position of the locking member corresponds to the forward position of the locking member, and the disengaged position of the locking member corresponds to the rearward position locking member.

In the engaged condition, the locking member 90 may be movable by the barrel 50 from the forward position toward the rearward position such as when the barrel moves under recoil. The locking member 90 may be positioned in the gap 42 between the forward 38 and rearward 40 bosses of the slide 30 such that movement of the locking member may be transferred to the slide. For example, movement of the locking member from the forward position toward the rearward position (e.g., as a result of the recoil movement of the barrel) may cause movement of the slide from the forward position toward the rearward position. Also, movement of the slide from the rearward position toward the forward position (e.g., by the recoil spring 84) moves the locking member toward its forward position.

The locking member 90 may include a locking lug 92 which 5 generally extends toward the barrel 50 and may extend into the locking recess 56 of the locking member in the engaged condition of the member 90, and the lug 92 may be withdrawn from the locking recess of the locking member in the disengaged condition of the member 90. The locking lug 92 can have a close fit with the locking recess 56.

The locking member 90 may be moved by the ram 78 of the guide rod 70 between the engaged and disengaged positions, and in the direction substantially perpendicular to the firing axis 11. A passage 94 may extend through the locking member 90 for receiving the ram 78 of the rod 70 as the locking member moves from the forward position toward the rearward position. As particularly illustrated in FIG. 7, the passage 94 may have an entry end 96 and an exit end 98, and the entry end may be slightly enlarged in area in comparison to the exit end. The passage 94 may include a shift surface 100 which is located toward the entry end of the passage and is positioned and configured to engage the guide surface 80 of the ram as the ram moves into the passage. The contact between the shift surface and the guide surface, as the locking member is moving rearwardly, deflects the locking member away from the barrel, disengaging the locking lug from the locking recess in the barrel, which effectively disengages the locking member from the barrel and leaves the locking member free to move with the slide to which the recoil movement has been imparted while the locking member and barrel were engaged together.

A deflecting element 102 may be configured to deflect the locking member 90 toward the engaged position as the locking member moves back toward the forward position. The deflecting element 102 may be positioned in the guide rod chamber 24 and may be positioned substantially opposite of the locking recess 56 of the barrel when the barrel is in, or close to, the forward position. The deflecting element may contact a surface on the locking member located on an opposite side of the locking member from the locking lug.

A barrel biasing element 104 may be configured to bias the barrel 50 into the barrel channel of the slide 30. Illustratively, the barrel biasing element 104 may include a ball bearing 106 which contacts in underside 108 of the barrel as the barrel moves between the forward and rearward positions. The ball bearing 106 may be at least partially located in a recess 110 in the frame 20 at a location adjacent to the barrel. The bearing 106 may rotate with respect to the frame as the underside of the barrel moves across the bearing. The barrel biasing element 104 may also include a biasing spring 112 positioned in the recess 110 which presses the bearing 106 against the underside of the barrel.

Referring now to FIGS. 8A to 8I, a full cycle operation of an exemplary embodiment is shown and described.

Figure 8A:
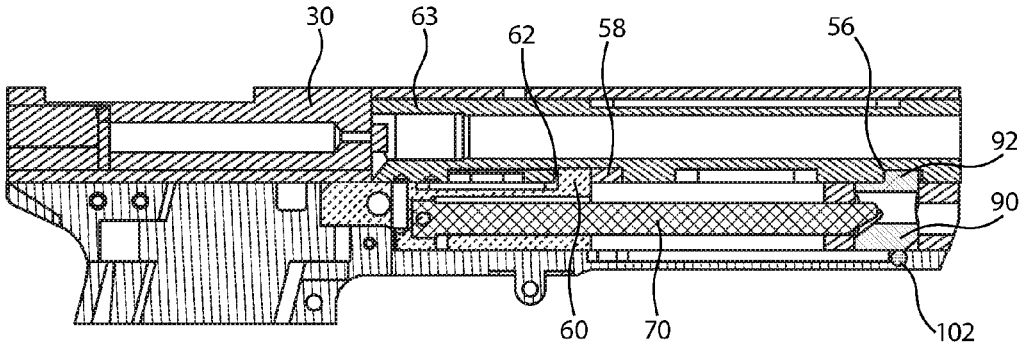
FIG. 8A is a side view of a pre-firing position of a firearm according to one embodiment.

FIG. 8A illustrates the firearm in pre-firing condition. The locking member 90 is in intimate contact with the locking recess 56 on the barrel. The guide rod 70 and locking member are spaced apart, such that the guide rod is not applying any force to the locking member. A rearward face 62 of the barrel stop 60 is in intimate contact with a rearward face 63 of the stop recess 58.

Figure 8B:
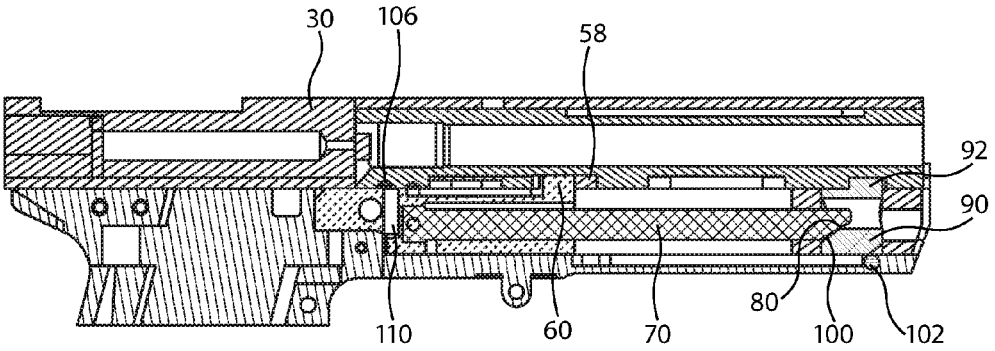
FIG. 8B is a side view of the firearm of FIG. 8A, immediately after firing where the locking member makes contact with the guide rod.

Referring to FIG. 8B, upon firing, the recoil force pushes the barrel rearward, the locking member is urged reward, causing contact between the guide surface 80 of the guide rod, and the shift surface 100 of the locking member. Further, as the barrel is urged reward during recoil, the barrel stop 60 disengages from the rearward face of the stop recess 58 and is spaced between the walls of the stop recess, such that the slide 30 and barrel are urged backward together. Still further, the locking pin 106 disengages from the rear locking pin recess 110 on the barrel.

Figure 8C:
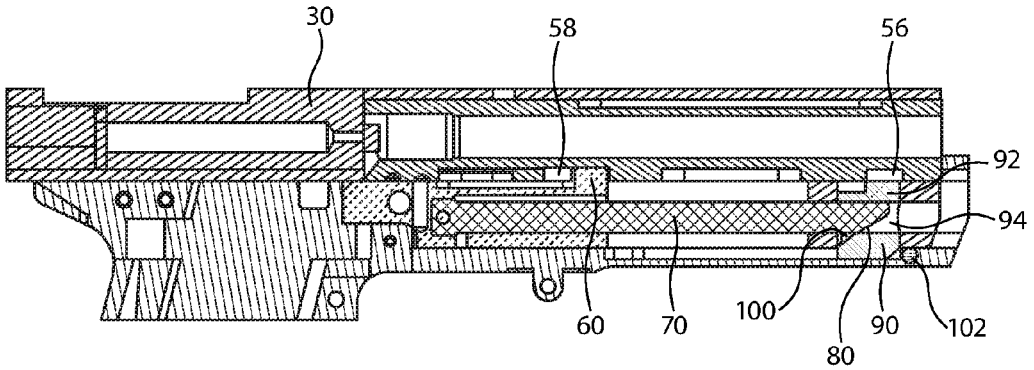
FIG. 8C is a side view of the firearm of FIG. 8B, continuing recoil as the locking member disengages from the barrel.

As illustrated in FIG. 8C, as the barrel continues moving rearward, the locking member 90 is urged away from the barrel as the guide surface 80 of the guide rod 70 is forced against the shift surface 100 of the locking member. The guide rod 70 enters the locking member passage 94. This downward movement of the locking member continues until the locking member is no longer within the locking recess 56. At this point, the barrel stop 60 is just slightly spaced apart from the front wall 59 of the stop recess 58, although closer than in FIG. 8B.

Figure 8D:
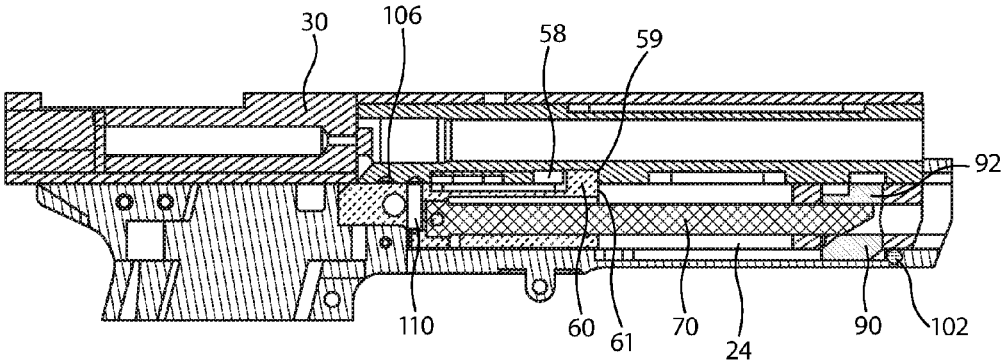
FIG. 8D is a side view of the firearm of FIG. 8C, continuing recoil with the barrel stop engaging the stop recess, preventing further rearward movement of the barrel.

As illustrated in FIG. 8D, the barrel's rearward movement is stopped when the barrel stop 60 makes intimate contact with the front wall 59 of the barrel lock recess 58. Further, the locking member 90 continues through the guide rod chamber 24 with the guide rod 70 sliding through the locking member passage. Further, the locking pin 110 is urged into the forward barrel locking pin recess 106.

Figure 8E:
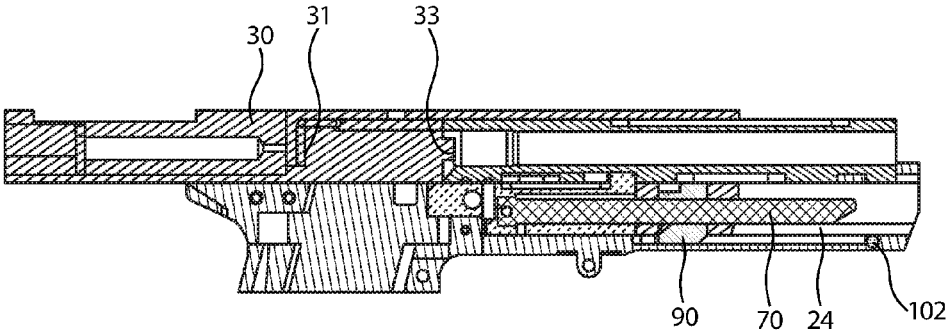
FIG. 8E is a side view of the firearm of FIG. 8D, continuing to a full recoil.

Since the locking member 90 has been disengaged, the slide 30 can continue to move reward to full recoil as illustrated in FIG. 8E, where the casing can be ejected and unfired cartridge loaded. Again, the locking member 90 continues its movement through the guide rod chamber 24 with the slide. The barrel remains locked from linear recoil due to contact with the barrel stop 60.

Figure 8F:
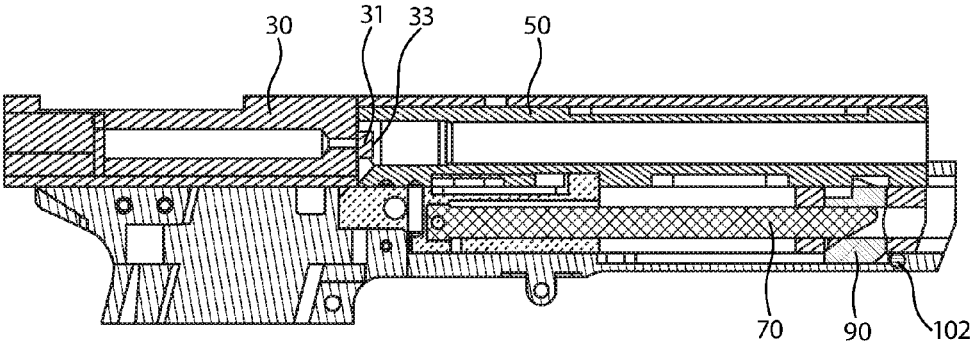
FIG. 8F is a side view of the firearm of FIG. 8E, beginning forward movement of the slide until contact with the barrel.

After full recoil, the slide 30 moves forward due to the tension of the compressed recoil spring (not shown) around the guide rod 70, applying pressure to the rearward boss 40 of the slide. The slide's movement continues until the slide projection 31 engages with the rear end 33 of barrel as illustrated in FIG. 8F. The locking member 90 also moves with the slide down the guide rod 70

Figure 8G:
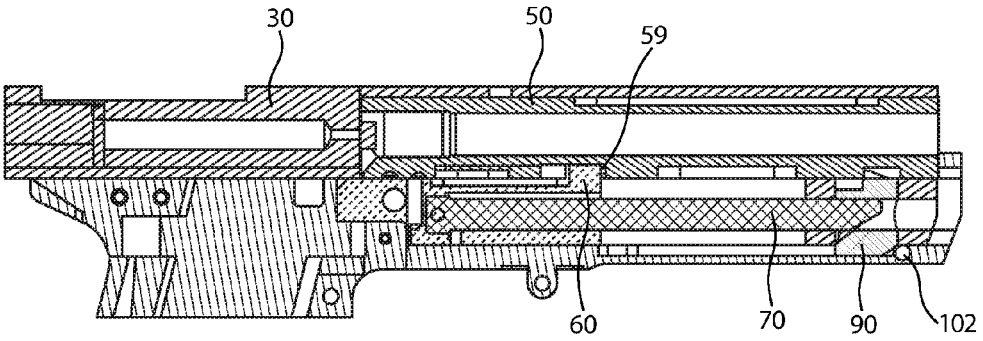
FIG. 8G is a side view of the firearm of FIG. 8F, continuing forward movement of the slide and barrel, releasing the barrel stop and the locking member engaging the deflecting member.

Once intimate contact with the slide projection 31 and the rear end 33 of the barrel is made, both the slide 30 and the barrel continue moving forward together, and the barrel stop 60 disengages from the forward wall of the stop recess 56 as illustrated in FIG. 8G. Further, as the barrel and slide move forward, the locking member 90 contacts the deflecting element 102, which urges the locking member upward toward the barrel and the locking lug 92 of the locking member into the locking recess 56.

Figure 8H:
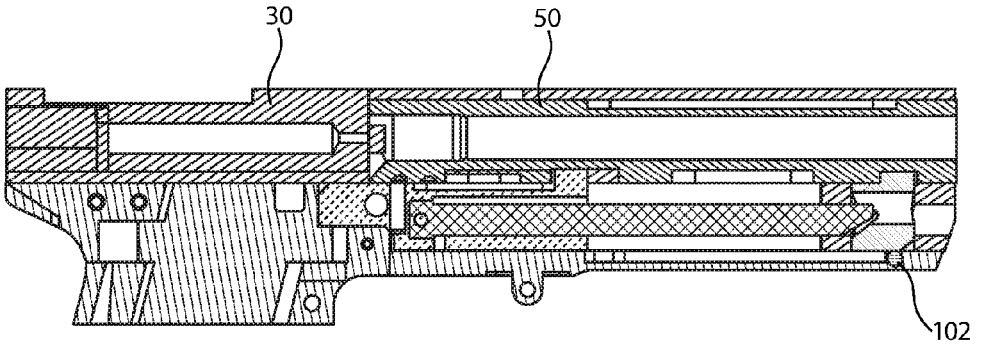
FIG. 8H is a side view of the firearm of FIG. 8G, continuing forward movement of the slide and barrel with the locking member fully engaged into the locking recess of the barrel.

The locking member 90 continues its upward movement until the locking lug 92 is in full engagement with the front barrel lock recess 56 as illustrated in FIG. 8H. The barrel stop 60 is still spaced apart from the rear wall of the stop recess 58.

Figure 8I:
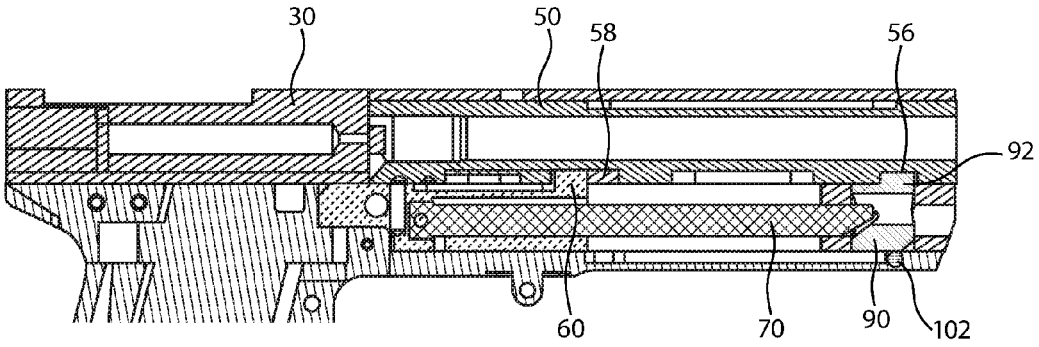
FIG. 8I is a side view of the firearm of FIG. 8H, continuing forward movement to the pre-firing condition with the barrel and slide in their forward position, locking member engaged and the barrel stop engaged, ready to be fired again.

The barrel and slide 30 continue to move forward until the rear wall of the stop recess 58 contacts the barrel stop 60 as illustrated in FIG. 8I. This completes the cycle and returns the firearm to a pre-firing state and ready for subsequent firing.

The present disclosure is a departure from the state of the art and the applicants have discovered that the system described herein may provide a number of advantages. For example, embodiments of the present disclosure relate to firearms that utilizes a linear recoil movement of the barrel while still providing out-of-battery delay that was traditionally only possible with tilting barrel designs. One advantage includes improved targeting accuracy resulting from the linear movement of the barrel along the firing axis of the projectile which maintains the alignment of the aiming structures on the slide with the barrel through the recoil movement.

Another advantage includes the reduction in space required for the simplified linear movement of the barrel as compared to the space required for the compound tilt and shift movement of the barrel in the tilting barrel designs. Manufacturing of the firearm may be simplified due to the simplified linear movement employed which requires less mechanical complexity. The extraction of the cartridge casing from the breech end of the barrel may also be simplified since the casing is not moving downwardly during the extraction operation.

Further, the system may permit the use of a shorter barrel size than is otherwise possible with firearms utilizing a tilting barrel approach. The distance between the firing axis of the barrel and the user's hand grip may also be decreased to increase control of the recoil of the firearm.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A firearm having a front and a rear, the firearm comprising:

a frame defining a guide rod chamber;

a slide movably mounted to the frame and configured to move between a side forwardmost position and a slide rearwardmost position, the slide defining a barrel channel;

a barrel having a bore and a bore axis and being at least partially positioned in the barrel channel of the slide and being movable between a barrel forward position and a barrel rearward position, the barrel being confined to move between the forward and rearward positions along a linear path;

a locking member connected to the slide to reciprocate therewith over the entire range between the slide forwardmost position and the slide rearwardmost position; and the locking member being movable with respect to the slide between an engaged condition in which the locking member engages the barrel to prevent relative movement of the barrel and slide and a disengaged condition in which the locking member is disengaged from the barrel to enable relative movement of the barrel and slide.

2. The firearm of claim 1, wherein the firearm further comprises a locking member having an engaged condition in which the locking member locks the barrel and slide together and a disengaged condition in which the locking member releases the slide from the barrel during rearward recoil movement.

3. The firearm of claim 2, wherein the firearm further comprises a guide rod located in the guide rod chamber of the frame and configured to guide movement of the slide between the forwardmost and rearwardmost positions, the guide rod having a forward portion of the guide rod forming a ram configured to engage the locking member and move the locking member between the engaged and disengaged conditions.

4. The firearm of claim 3 wherein the locking member has a passage for receiving the ram of the guide rod as the locking member moves rearwardly from the forwardmost position toward the rearwardmost position.

5. The firearm of claim 4 wherein the passage has an entry end and an exit end, the passage having a shift surface located toward the entry end of the passage and configured to engage a guide surface on the ram of the guide rod, the shift surface and the guide surface being configured to move the locking member from the engaged condition to the disengaged condition when the guide surface engages the shift surface and enters the passage.

6. The firearm of claim 5 wherein the ram moves the locking member away from the barrel.

7. The firearm of claim 2 additionally comprising a deflecting element configured to deflect the locking member toward the engaged position as the locking member moves toward a forward position of the locking member.

8. The firearm of claim 1 wherein the barrel has a stop recess formed thereon, and additionally comprising a barrel stop extending into the stop recess of the barrel to limit movement of the barrel and set the forward position and the rearward position of the barrel.

9. The firearm of claim 1, wherein the locking member is connected to a forward portion of the slide.

10. The firearm of claim 1, wherein the locking member engages a forward portion of the barrel.

11. The firearm of claim 1, wherein the slide defines a cylindrical bore and wherein the locking member is a cylindrical element closely received in the bore.

12. A firearm comprising:

a frame;

a slide coupled with the frame and operable to reciprocate between a forwardmost slide position and a rearwardmost slide position, wherein the slide defines a barrel channel;

a barrel defining a bore axis and received in the barrel channel, wherein the barrel is operable to reciprocate along the bore axis between a forward barrel position and a rearward barrel position;

a locking member coupled to the slide and movable transversely to the bore axis between an engaged position in which the barrel is engaged to the slide and a disengaged position in which the barrel is disengaged from the slide; and the locking member being engaged to the slide throughout the entire reciprocation between forwardmost slide position and the rearwardmost slide position as the slide reciprocates with respect to the barrel.

13. The firearm of claim 12, wherein the firearm further comprises a first actuator connected to the frame, wherein the first actuator is configured to disengage the locking member from an engaged position.

14. The firearm of claim 13, wherein the first actuator comprises a rod surrounded by a recoil spring biasing the slide forward with respect to the frame.

15. The firearm of claim 13, wherein the first actuator comprises a guide surface operable to shift the position the locking member away from the barrel during initial rearward movement of the barrel and slide.

16. The firearm of claim 15, wherein the locking member comprises a shift surface that is complementary to the guide surface on the first actuator.

17. The firearm of claim 12, wherein the firearm further comprises a deflecting element connected to the frame and operable to move the locking member toward the barrel based on the position of the slide with respect to the frame.

18. The firearm of claim 12, wherein the barrel is confined to move between the forward and rearward positions along a linear path along the bore axis.

19. The firearm of claim 12, wherein the firearm further comprises a barrel stop configured to limit the range of lateral movement of the barrel.

20. The firearm of claim 19, wherein the barrel stop comprises a protrusion adapted to engage with a stop recess on the barrel, wherein the barrel stop is fixed with respect to the frame.

21. The firearm of claim 12, wherein the slide is configured to reciprocate over a longer distance than the barrel is configured to reciprocate.

22. The firearm of claim 21, wherein the slide and barrel are configured to reciprocate together for an initial range of motion after firing until the locking member is disengaged and the locking member is engaged where the slide continues to reciprocate independent of the barrel.

23. A firearm comprising:

a frame;

a slide coupled with the frame and operable to reciprocate between forwardmost slide position and rearwardmost slide position, wherein the slide defines a barrel channel;

a barrel defining a bore axis and received in the barrel channel, wherein the barrel is operable to reciprocate along the bore axis between a forward barrel position and a rearward barrel position, and wherein the barrel includes a locking recess and a stop recess;

a locking member coupled to the slide to reciprocate along with the slide through the slide's entire range of reciprocation and movable with respect to the slide between an engaged position in which the locking member locks lateral movement of the barrel with the slide and a disengaged position in which the locking member is disengaged from the barrel allowing independent lateral movement of the barrel and the slide; and a barrel stop fixed to the frame and disposed with the stop recess, wherein the stop recess has a larger lateral length than the lateral length of the barrel stop such that the barrel stop can be disposed within the stop recess without contacting a forward or rearward wall of the stop recess;

wherein the barrel is confined to move between the forward and rearward positions along a linear path along the bore axis.

24. A firearm having a front and a rear, the firearm comprising:

a frame defining a guide rod chamber;

a slide movably mounted to the frame and configured to move between a forward position and a rearward position, the slide defining a barrel channel;

a barrel having a bore and a bore axis and being at least partially positioned in the barrel channel of the slide and being movable between a forward position and a rearward position, the barrel being confined to move between the forward and rearward positions along a linear path;

a locking member having an engaged condition in which the locking member locks the barrel and slide together and a disengaged condition in which the locking member releases the slide from the barrel during rearward recoil movement;

a guide rod located in the guide rod chamber of the frame and configured to guide movement of the slide between the forward and rearward positions, the guide rod having a forward portion of the guide rod forming a ram configured to engage the locking member and move the locking member between the engaged and disengaged conditions; and wherein the locking member has a passage for receiving the ram of the guide rod as the locking member moves rearwardly from the forward position toward the rearward position.

* * * * *